US011174758B2

(12) United States Patent
Iwai et al.

(10) Patent No.: US 11,174,758 B2
(45) Date of Patent: Nov. 16, 2021

(54) STEAM TURBINE

(71) Applicants: KABUSHIKI KAISHA TOSHIBA, Tokyo (JP); TOSHIBA ENERGY SYSTEMS & SOLUTIONS CORPORATION, Kawasaki (JP)

(72) Inventors: Shogo Iwai, Tokyo (JP); Tsuguhisa Tashima, Yokohama Kanagawa (JP); Takahiro Ono, Tokyo (JP); Daichi Fukabori, Tokyo (JP)

(73) Assignees: KABUSHIKI KAISHA TOSHIBA, Tokyo (JP); TOSHIBA ENERGY SYSTEMS & SOLUTIONS CORPORATION, Kawasaki (JP)

( * ) Notice: Subject to any disclaimer, the term of this patent is extended or adjusted under 35 U.S.C. 154(b) by 0 days.

(21) Appl. No.: 17/116,697

(22) Filed: Dec. 9, 2020

(65) Prior Publication Data

US 2021/0180469 A1 Jun. 17, 2021

(30) Foreign Application Priority Data

Dec. 11, 2019 (JP) ..... JP2019-224084

(51) Int. Cl.
*F01D 25/26* (2006.01)
*F01D 25/28* (2006.01)
*F01D 25/30* (2006.01)

(52) U.S. Cl.
CPC ..... *F01D 25/26* (2013.01); *F01D 25/28* (2013.01); *F01D 25/30* (2013.01); *F05D 2220/31* (2013.01)

(58) Field of Classification Search
CPC ..... F01D 25/24; F01D 25/28; F01D 25/26; F01D 25/30; F01D 25/162; F05D 2220/31; F05D 2220/76; F05D 2240/91
See application file for complete search history.

(56) References Cited

U.S. PATENT DOCUMENTS 3,773,431 A * 11/1973 Bellati ..... F01D 25/28 415/108
3,881,843 A * 5/1975 Meylan ..... F01D 25/28 415/213.1

(Continued)

FOREIGN PATENT DOCUMENTS

EP 2 557 277 A2 2/2013
JP 2018-084203 A1 5/2018
WO WO-2011/026516 A1 3/2011

*Primary Examiner* — Shafiq Mian
(74) *Attorney, Agent, or Firm* — Foley & Lardner LLP

(57) ABSTRACT

The steam turbine of an embodiment has: an outer casing; an inner casing housed in the outer casing; a turbine rotor penetrating the inner casing and the outer casing; and a support beam provided in the outer casing, extending in an axial direction of the turbine rotor, and supporting the inner casing, and is disposed on a foundation. The outer casing has outer casing support portions provided in both end portions of the outer casing in the axial direction of the turbine rotor and supported by the foundation. The support beam has beam end portions provided in both end portions in the axial direction of the turbine rotor. The outer casing support portion has a support surface supporting the beam end portion. Further, the outer casing includes a height adjustment mechanism capable of accessing the beam end portion from the outside of the outer casing.

5 Claims, 5 Drawing Sheets

(56) References Cited

U.S. PATENT DOCUMENTS

| | | | | |
|---|---|---|---|---|
| 5,779,435 | A * | 7/1998 | Lageder | F01D 25/24 184/106 |
| 10,487,692 | B2 * | 11/2019 | Ono | F01D 25/26 |
| 2018/0142574 | A1 * | 5/2018 | Ono | F01D 25/28 |
| 2019/0345843 | A1 | 11/2019 | Yanagisawa et al. | |

* cited by examiner

STEAM TURBINE

CROSS-REFERENCE TO RELATED APPLICATIONS

This application is based upon and claims the benefit of priority from Japanese Patent Application (JP No. 2019-224084), filed on Dec. 11, 2019; the entire contents of which are incorporated herein by reference.

FIELD

Embodiments of the present invention relate to a steam turbine.

BACKGROUND

A steam turbine plant has a high-pressure steam turbine in which main steam mainly works, an intermediate-pressure steam turbine in which reheated steam works, and a low-pressure steam turbine in which the steam discharged from the intermediate-pressure steam turbine works. Among the above, the low-pressure steam turbine is connected to a steam condenser, and the steam discharged from the low-pressure steam turbine is condensed in the steam condenser to generate condensed water.

An outer casing of the low-pressure steam turbine is configured as a pressure container. Further, in view of assembly performance and disassembly performance, the outer casing is divided into two portions, i.e., an outer casing upper half portion and an outer casing lower half portion, by a horizontal plane including a shaft axis of a turbine rotor. A flange portion of the outer casing upper half portion and a flange portion of the outer casing lower half portion are fastened by a fastening member such as a bolt. A foot plate is provided on a side surface near the flange portion of the outer casing lower half portion. The foot plate is fixed to a foundation, and the outer casing is supported by the foundation by the foot plate.

In the low-pressure steam turbine, an outer surface of the outer casing is exposed to the atmosphere, but the inside of the outer casing is made in a vacuum state by the steam condenser. Thereby, the outer casing receives a load due to a difference between a pressure received by the outer surface and a pressure received by an inner surface. This load is generally referred to as a vacuum load. When receiving the vacuum load, the outer casing may be deformed in a manner to be dented inward. Therefore, an inner casing supported by the outer casing lower half portion may receive an influence of deformation of the outer casing due to the vacuum load, resulting in a possibility of change of a supporting position.

Meanwhile, the turbine rotor is supported rotatably by a rotor bearing. A cone portion is provided in a center portion of an end plate of the outer casing. The cone portion is formed to protrude from the end plate toward the inside of the outer casing. The cone portion is supported by the outer casing. The cone portion is integral to or separate from a bearing stand, and the bearing stand is supported by the foundation. When the rotor bearing receives a load from the turbine rotor, the load is transmitted to the outer casing via the cone portion, resulting in possible deformation of the outer casing. The cone portion, even if it is individual to or separate from the bearing stand, is connected to the outer casing, so that deformation of the outer casing reaches the rotor bearing via the cone portion. Consequently, there is a possibility that a supporting position of the rotor bearing may move. Further, since the bearing stand is supported by the outer casing, the supporting position of the rotor bearing may move also by the deformation of the outer casing due to the vacuum load.

As described above, when the supporting position of the rotor bearing moves, the shaft axis of the turbine rotor constituting a rotating unit may be bent or tilted. On the other hand, as described above, the supporting position of the inner casing constituting a stationary unit may move when receiving the influence of the deformation of the outer casing due to the vacuum load or the turbine rotor load. Therefore, considering bending of the shaft axis of the turbine rotor described above, it is difficult to make a gap between the rotating unit and stationary unit small, in order to prevent contact between the rotating unit and the stationary unit. In such a case, loss due to steam leaking from between the rotating unit and the stationary unit increases, resulting in a possible reduction of turbine performance.

In order to solve the above-described problem, the technology below is suggested. Concretely, an outer casing is supported by a foundation by support portions provided in both end portions in an axial direction of a turbine rotor, and an inner casing housed in the outer casing is supported by an inner casing support beam extending in the axial direction. The inner casing support beam has beam end portions provided in both end portions in the axial direction and the support portion of the outer casing has a support surface supporting the beam end portion. In this structure, the inner casing support beam is supported by the foundation via the outer casing, and further, mounted on the outer casing via a sliding portion without having physical connection to the outer casing. Therefore, heat deformation or deformation due to a vacuum load of the outer casing is not transmitted to the inner casing via the inner casing support beam. Thereby, a gap between a rotating unit and a stationary unit is small and a loss due to steam leaking is reduced, so that improvement of turbine performance can be realized.

However, in the above-described technology, when an installation process of a turbine is considered, making a gap between a rotating unit and a stationary unit small is not sometimes easy under a specific condition. In particular, as a low-pressure steam turbine becomes large, the above-described problem becomes likely to occur. It is because the larger low-pressure steam turbine leads to a longer support beam supporting an inner casing, thereby causing stiffness to become smaller, and leads to a larger load by the inner casing and a nozzle diaphragm housed inside the inner casing, so that deflection of the support beam supporting the inner casing becomes large.

In the turbine installation process, normally, there are assembled an outer casing lower half portion, a support beam, an inner casing lower half portion, a nozzle diaphragm lower half portion, a turbine rotor, a nozzle diaphragm upper half portion, an inner casing upper half portion, and an outer casing upper half portion in sequence. A state where the nozzle diaphragm upper half portion and the inner casing upper half portion are assembled is referred to as a Tops On state, and the support beam of the inner casing in the Tops On state is considerably deflected. A state before the nozzle diaphragm lower half portion, the nozzle diaphragm upper half portion, and the inner casing upper half portion are assembled is referred to as a Tops Off state. A steam turbine is assembled such that a rotating unit and a stationary unit do not come into contact at a start/stop time or during operation. Therefore, in order to make a gap which intervenes between the rotating unit and the stationary unit in an intended state, installation is performed such that the nozzle diaphragm and packing provided in the nozzle diaphragm are intentionally offset vertically and horizontally.

However, when deflection of the support beam supporting the inner casing is large as described above, it is necessary to increase an offset amount at the time of installation of the turbine rotor. When the offset amount is larger than the gap between the rotating unit and the stationary unit at a time of operation of the turbine, the rotating unit and the stationary unit come into contact at the time of installation. Consequently, a relative positional relation between the rotating unit and the stationary unit cannot be grasped easily, which makes it impossible to set a target gap and perform installation. This leads to a large gap between the rotating unit and the stationary unit, resulting in an increase of steam leaking and worsened performance.

Further, the offset amount is determined based on a difference between the Tops on State and the Tops Off state. However, in a practical installation process, after temporary assembling is done first to obtain the Tops On state, deflection of the support beam supporting the inner casing is measured, and then disassembling is done to obtain the Tops Off state again, and thereafter, the turbine rotor is installed. Therefore, futile assembly and disassembly work is required, causing a problem of a long installation process on-site The present invention is made in consideration of the above-described problems, and its object is to provide a steam turbine which enables a reduction of a loss due to steam leaking to thereby improve turbine performance, and enables shortening of an installation process on-site.

DETAILED DESCRIPTION

A steam turbine of an embodiment has an outer casing, an inner casing housed in the outer casing, a turbine rotor penetrating the inner casing and the outer casing, and a support beam provided in the outer casing, extending in an axial direction of the turbine rotor and supporting the inner casing, and is disposed on a foundation. The outer casing has outer casing support portions provided in both end portions of the outer casing in the axial direction of the turbine rotor and supported by the foundation. The support beam has beam end portions provided in both end portions in the axial direction of the turbine rotor. The outer casing support portion has a support surface supporting the beam end portion. Further, the outer casing includes a height adjustment mechanism enabling access to the beam end portion from the outside of the outer casing.

An entire configuration of the steam turbine in the embodiment will be described using FIG. 1, FIG. 2, and FIG. 3.

Figure 1:
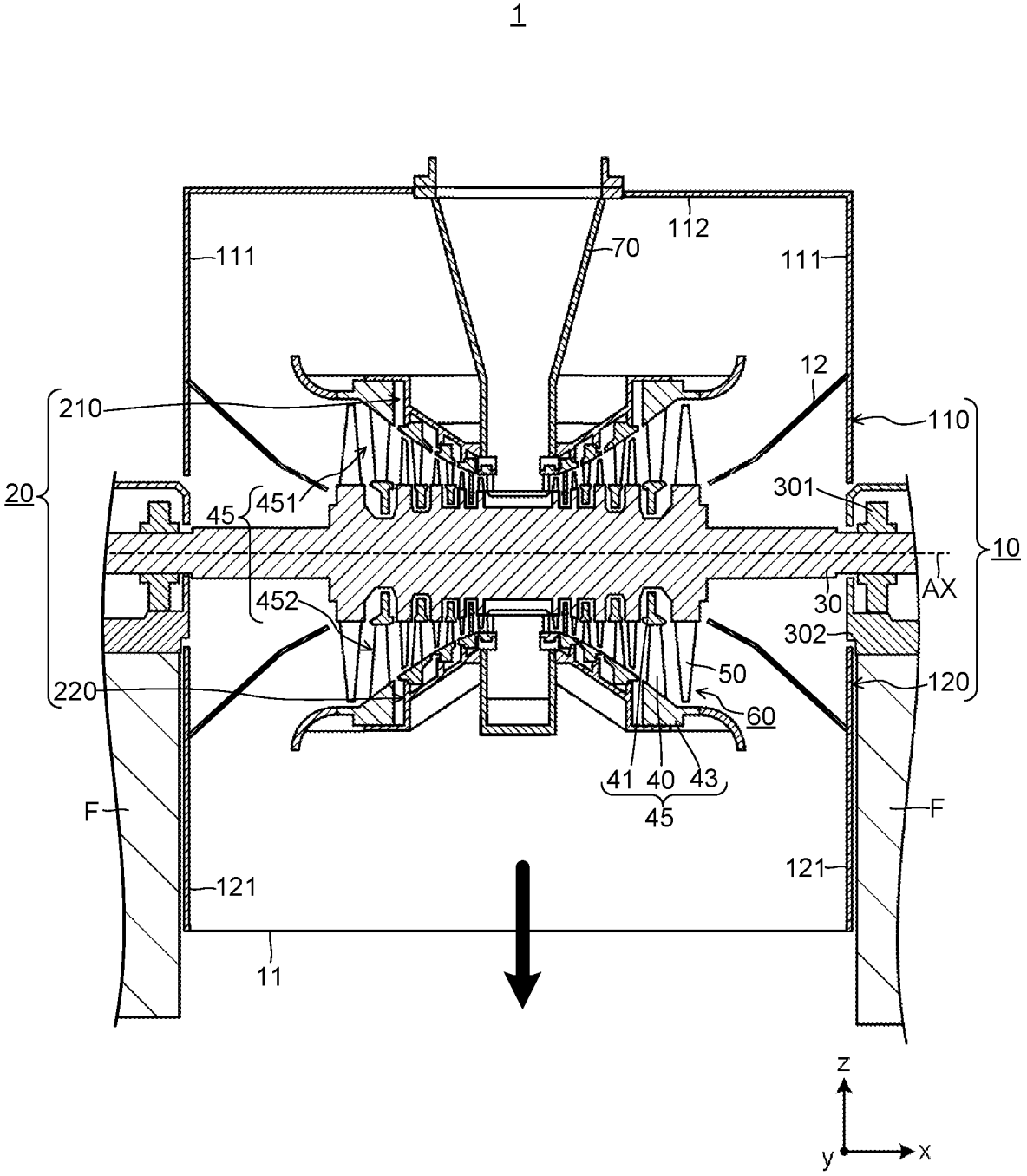
FIG. 1 is a longitudinal cross-sectional view schematically illustrating a steam turbine in an embodiment.

FIG. 1 illustrates a longitudinal cross-section (xz surface), where a longitudinal direction is a vertical direction z, a lateral direction is a first horizontal direction x, and a direction perpendicular to a plane is a second horizontal direction y. FIG. 2 illustrates a horizontal surface (xy surface), where a longitudinal direction is the second horizontal direction y, a lateral direction is the first horizontal direction x, and a direction perpendicular to a plane is the vertical direction z. FIG. 3 illustrates a side surface (yz surface), where a longitudinal direction is the vertical direction z, a lateral direction is the second horizontal direction y, and a direction perpendicular to a plane is the first horizontal direction x.

In this embodiment, a steam turbine 1 is a double-flow low-pressure steam turbine, and there is presented an example of a case of a downward exhaust system where steam is discharged downward toward a steam condenser (not shown).

In this embodiment, the steam turbine 1 is supported by a foundation F. The steam turbine 1 has an outer casing 10, an inner casing 20, and a turbine rotor 30, and is configured such that the outer casing 10 houses the inner casing 20 and that the turbine rotor 30 penetrates the inner casing 20 and the outer casing 10. A shaft axis AX of the turbine rotor 30 runs along the first horizontal direction x.

The steam turbine 1 is a multistage axial flow turbine in which a plurality of turbine stages 60 that include stationary blades 40 and rotor blades 50 are provided in an axial direction along the shaft axis AX inside the inner casing 20.

A plurality of the stationary blades 40 exist, and the plural stationary blades 40 are arranged in a rotational direction of the turbine rotor 30 between a diaphragm inner ring 41 and a diaphragm outer ring 43 to thereby constitute a nozzle diaphragm 45. The nozzle diaphragm 45 is constituted by combining a nozzle diaphragm upper half portion 451 and a nozzle diaphragm lower half portion 452. The nozzle diaphragm upper half portion 451 and the nozzle diaphragm lower half portion 452 correspond to members obtained by dividing the nozzle diaphragm 45 into two by a horizontal plane including the shaft axis AX of the turbine rotor 30 in the vertical direction z.

A plurality of the rotor blades 50 exist, and the plural rotor blades 50 are arranged along the rotational direction of the turbine rotor 30.

In the steam turbine 1, a steam supply pipe 70 is connected to the inner casing 20, and steam is supplied to the steam supply pipe 70 as working fluid. The steam supplied to the steam supply pipe 70 sequentially flows in the plurality of turbine stages 60 inside the inner casing 20. In other words, the working fluid flows from the first turbine stage 60 to the final turbine stage 60, expanding and working in each turbine stage 60. Thereby, the turbine rotor 30 rotates with the shaft axis AX being a rotation axis, and a generator (not shown) connected to the turbine rotor 30 generates electric power.

In the steam turbine 1, the steam passing through the final turbine stage 60 is discharged via a cone portion 12 from a downward exhaust port 11 provided in a lower end portion of the outer casing 10. The steam discharged from the downward exhaust port 11 is supplied to the steam condenser (not shown) connected to the steam turbine 1, and condensed in the steam condenser to generate condensed water.

The outer casing 10 constituting the above-described steam turbine 1 will be described in detail.

Figure 3:
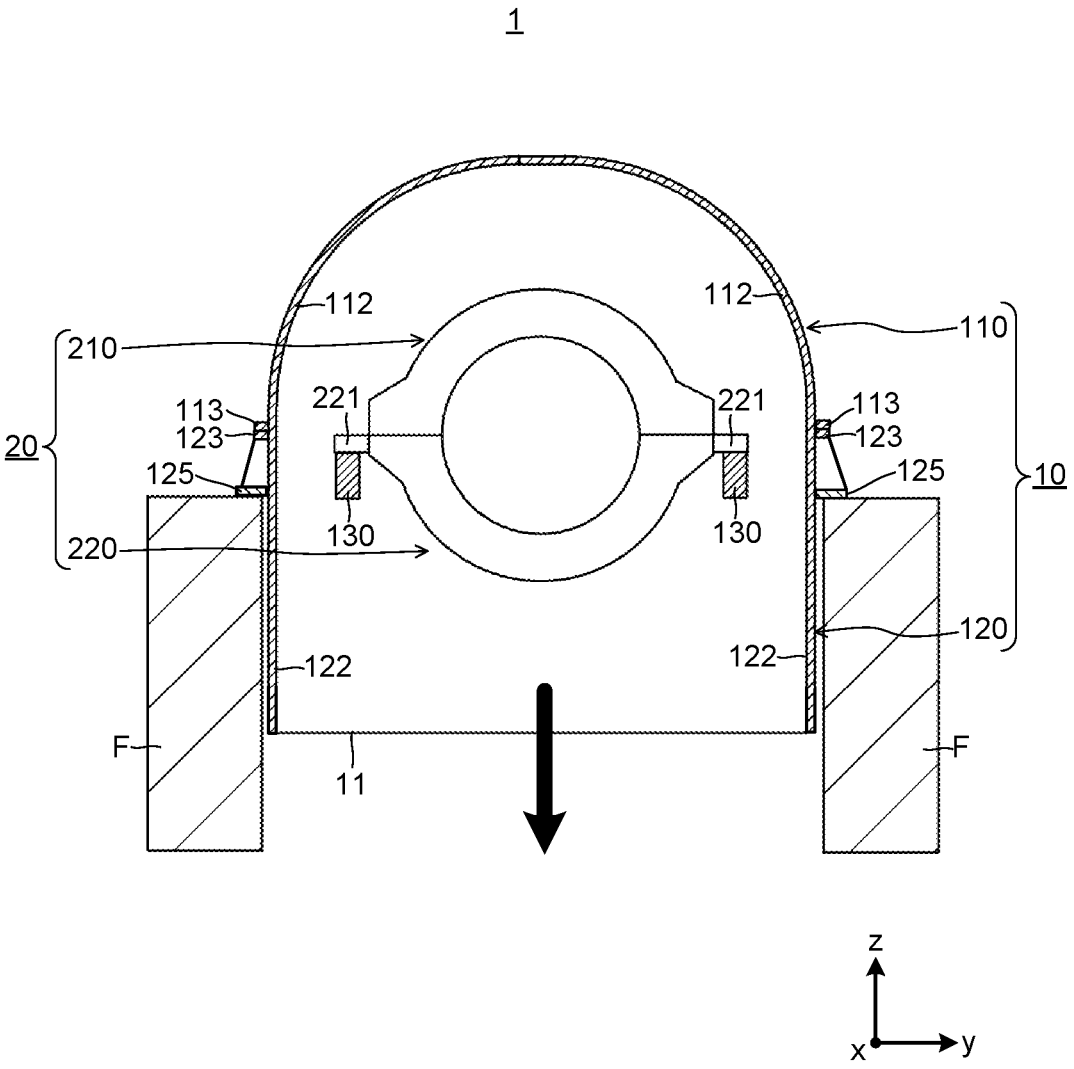
FIG. 3 is a side cross-sectional view schematically illustrating the steam turbine in the embodiment.

The outer casing 10 has an outer casing upper half portion 110 and an outer casing lower half portion 120 as illustrated in FIG. 1 and FIG. 3. The outer casing lower half portion 120 and the outer casing upper half portion 110 correspond to members obtained by dividing the outer casing 10 into two by the horizontal surface including the shaft axis AX of the turbine rotor 30 in the vertical direction z.

The outer casing upper half portion 110 has upper half end plates 111 and an outer casing upper half main body 112. The upper half end plates 111 are provided in pair in both end portions in the axial direction of the turbine rotor 30. The outer casing upper half main body 112 is provided between the pair of upper half end plates 111. The outer casing upper half main body 112 is formed in a half-cylinder shape in a manner to extend in the axial direction of the turbine rotor 30. Further, upper half flange portions 113 are provided in lower ends of the upper half end plates 111 and lower ends of the outer casing upper half main body 112.

The outer casing lower half portion 120 has lower half end plates 121 and lower half main body plates 122. The lower half end plates 121 are provided in pair in both end portions in the axial direction of the turbine rotor 30. The lower half main body plates 112 are provided in pair in a manner to sandwich the pair of lower half end plates 121 in the second horizontal direction y. In other words, the outer casing lower half portion 120 is formed in a rectangular cylinder shape. Further, lower half flange portions 123 are provided in upper end portions of the lower half end plates 121 and upper end portions of the lower half main body plates 122.

In the outer casing 10, the upper half flange portion 113 and the lower half flange portion 123 are fastened by a fastening member (not shown) such as a bolt.

Figure 2:
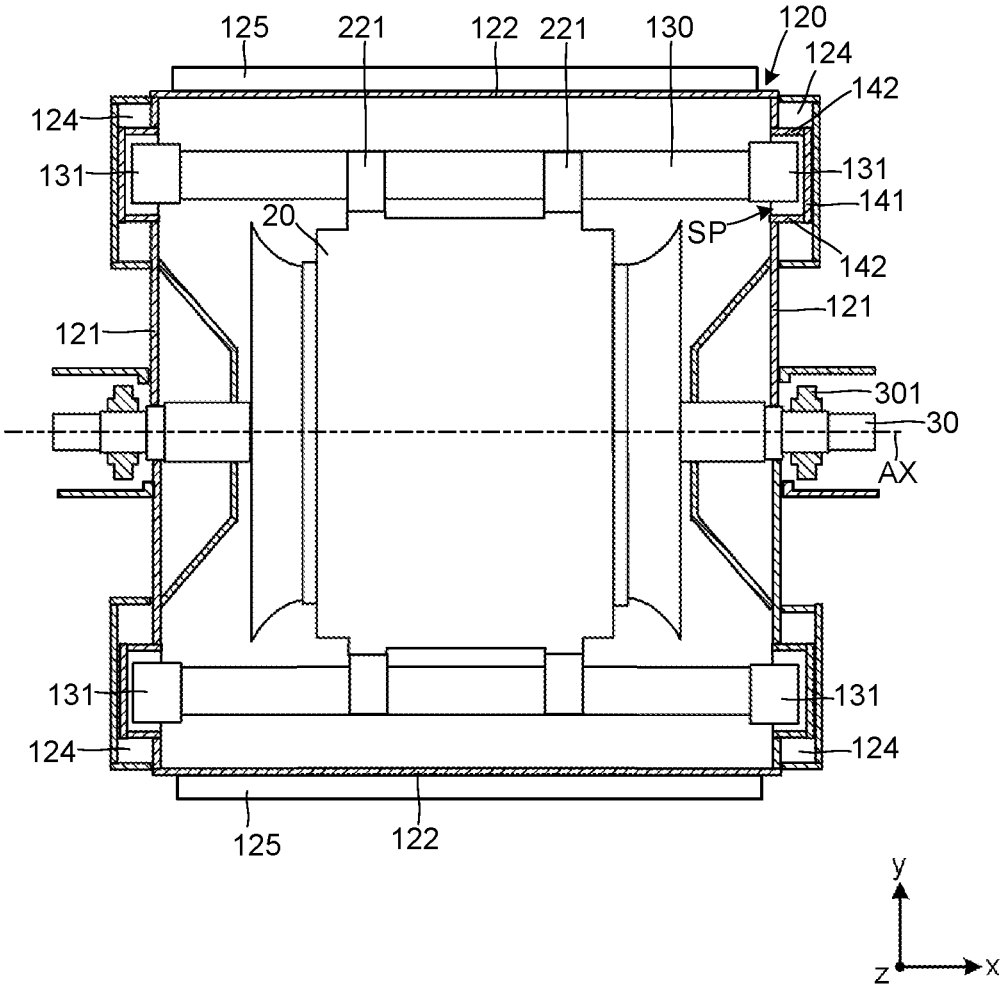
FIG. 2 is a horizontal cross-sectional view schematically illustrating the steam turbine in the embodiment.

The outer casing lower half portion 120 includes first foot plates 124 (outer casing support portions) provided in the lower half end plate 121 as illustrated in FIG. 2. The first foot plate 124 is supported by the foundation F in a circumference of the outer casing 10. Concretely, the first foot plate 124 is fixed to the foundation F and makes the outer casing 10 be supported by the foundation F. The first foot plates 124 are disposed such that a pair of the first foot plates 124 line up in the first horizontal direction x and that a pair of the first foot plates 124 line up in the second horizontal direction y.

The outer casing lower half portion 120 includes a second foot plate 125 provided in the lower half main body plate 122 as illustrated in FIG. 2 and FIG. 3. The second foot plate 125, similarly to the first foot plate 124, is supported by the foundation F in the circumference of the outer casing 10. Concretely, the second foot plate 125 is fixed to the foundation F and make the outer casing 10 be supported by the foundation F. The second foot plates 125 are arranged such that a pair of the second foot plate 125 line up in the second horizontal direction y.

As illustrated in FIG. 2, the outer casing lower half portion 120 is provided with a pair of support beams 130 in order to support the inner casing 20. The pair of support beams 130 extend in the axial direction of the turbine rotor 30 in the vicinity of a shaft axis height of the turbine rotor 30. The pair of support beams 130 are disposed to sandwich the shaft axis AX in the second horizontal direction y. Here, the support beam 130 intervenes between the inner casing 20 and the lower half main body plate 122 of the outer casing lower half portion 120 in the second horizontal direction y, and disposed at a position closer to the inner casing 20 than the lower half main body plate 122.

The support beam 130 has beam end portions 131 in both end portions in the axial direction of the turbine rotor 30.

Figure 4:
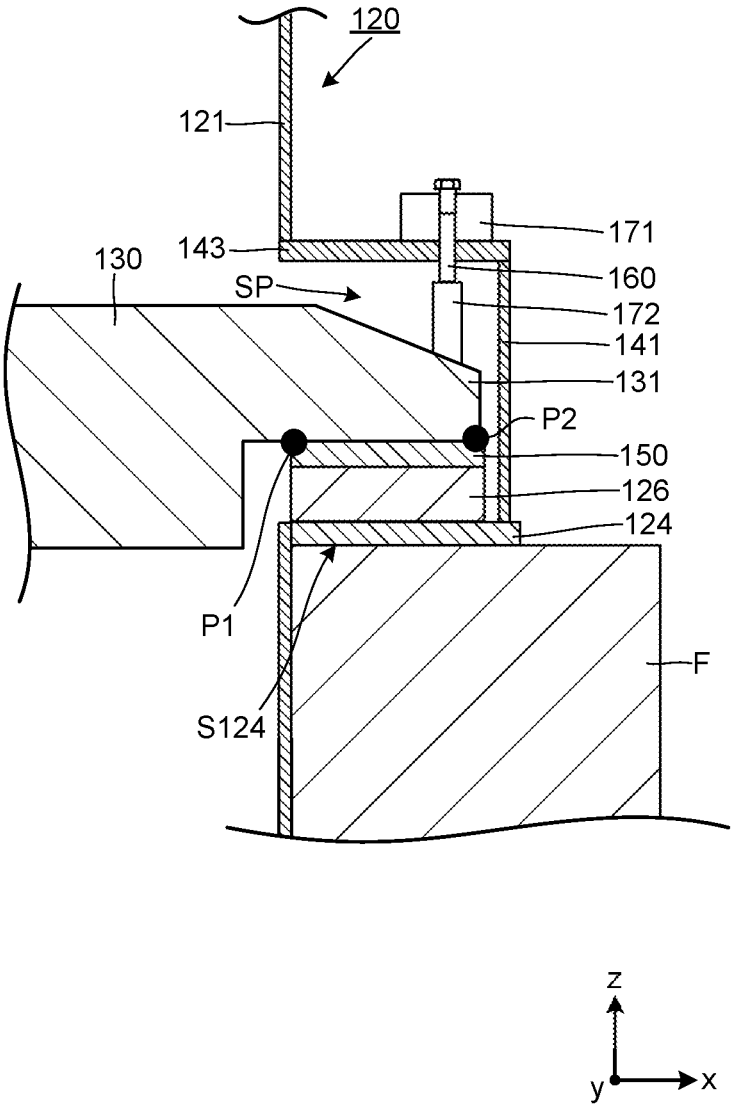
FIG. 4 is a view enlargedly illustrating a beam end portion in the steam turbine in the embodiment.

The beam end portion 131 will be described by further using FIG. 4. In FIG. 4, similarly to in FIG. 3, a longitudinal direction is the vertical direction z, a lateral direction is the second horizontal direction y, and a direction perpendicular to a plane is the first horizontal direction x.

The beam end portion 131 is supported by a support surface S124 being an upper surface of the first foot plate 124 via a plate 126 as illustrated in FIG. 2 and FIG. 4. Thereby, a height position of the support beam 130 is a position in relation to an upper surface of the foundation F. Further, the beam end portion 131 is slidable in the axial direction of the turbine rotor 30 in the support surface S124.

Concretely, as illustrated in FIG. 2 and FIG. 4, the beam end portion 131 is housed in an end portion housing space SP provided above the first foot plate 124. The end portion housing space SP is formed to protrude in a convex shape from the lower half end plate 121 toward the outside. Here, the end portion housing space SP is zoned by a first end wall 141, a pair of second end walls 142, and a ceiling wall 143 which constitute the outer casing lower half portion 120, above the first foot plate 124.

As illustrated in FIG. 4, a low-friction member 150 intervenes between the beam end portion 131 and the support surface S124 of the first foot plate 124. A surface of the low-friction member 150 is configured to have a lower friction coefficient than the friction coefficient of the support surface S124. For example, the low-friction member 150 is formed by using a low-friction material such as Teflon (registered trademark). For example, the low-friction member 150 may be formed entirely by the low-friction material or may have a configuration in which a surface (at least, an upper surface) of a metal material of a bed plate shape is coated with the low-friction material.

Further, as illustrated in FIG. 4, a height adjustment screw 160 is provided above the beam end portion 131. The height adjustment screw 160 is provided to be able to access the beam end portion 131 from the outside of the outer casing 10 in order to adjust deformation of the support beam 130.

In this embodiment, a first block 171 is disposed on an upper surface of the ceiling wall 143 which is positioned above the end portion housing space SP in the outer casing 10. The first block 171 is provided with a female screw portion (not shown), and by a male screw portion (not shown) of the height adjustment screw 160 being set in the female screw portion of the first block 171, the height adjustment screw 160 penetrates the first block 171 and the ceiling wall 143 from the outside of the outer casing 10.

Further, a second block 172 is disposed on an upper surface of the beam end portion 131. A tip of the height adjustment screw 160 penetrating the first block 171 and the ceiling wall 143 is positioned above the second block 172 inside the end portion housing space SP. Therefore, by rotating the height adjustment screw 160, the tip of the height adjustment screw 160 is brought into contact with an upper surface of the second block 172, so that the second block 172 can be pressed to the beam end portion 131.

The inner casing 20 constituting the above-described steam turbine 1 will be described in detail.

The inner casing 20 has an inner casing upper half portion 210 and an inner casing lower half portion 220 as illustrated in FIG. 1 and FIG. 3. The inner casing upper half portion 210 and the inner casing lower half portion 220 correspond to members obtained by dividing the outer casing 10 into two by the horizontal surface including the shaft axis AX of the turbine rotor 30 in the vertical direction z.

As illustrated in FIG. 2 and FIG. 3, the inner casing lower half portion 220 has an arm portion 221 supported by the support beam 130. The arm portion 221 is formed to protrude toward the outside from an upper end portion of the inner casing lower half portion in the second horizontal direction y. The four arm portions 221 are provided and disposed such that a pair of the arm portions 221 line up in the first horizontal direction x and that a pair of the arm portions 221 sandwich the shaft axis AX in the second horizontal direction y.

The turbine rotor 30 constituting the above-described steam turbine 1 will be described in detail.

The turbine rotor 30 is rotatably supported by rotor bearings 301 as illustrated in FIG. 1 and FIG. 2. The rotor bearing 301 is supported by a bearing stand 302, and the bearing stand 302 is supported by the foundation F provided in the circumference of the outer casing 10. Concretely, the bearing stand 302 is fixed the foundation F and makes the rotor bearing 301 be supported by the foundation F.

As described above, the rotor bearing 301 is not supported by the outer casing 10, but is directly supported by the foundation F by the bearing stand 302. Therefore, a height position of the turbine rotor 30 is a position in relation to an upper surface of the foundation F.

Installation of the steam turbine 1 of this embodiment will be described.

When the above-described steam turbine 1 is installed, first, the outer casing lower half portion 120 is disposed on the foundation F. Then, the bearing stand 302 is disposed on the foundation F. Thereafter, the inner casing lower half portion 220 and the nozzle diaphragm lower half portion 452 are sequentially disposed inside the outer casing lower half portion 120 (see FIG. 1).

Here, the support beam 130 is disposed in the outer casing lower half portion 120 such that the beam end portion 131 is supported by the support surface S124 of the first foot plate 124 provided in the lower half end plate 121 of the outer casing lower half portion 120. Thereafter, the inner casing lower half portion 220 is disposed such that the inner casing lower half portion 220 is supported by the support beam 130 (see FIG. 2, FIG. 3).

Next, the rotor bearing 301 is installed on the bearing stand 302, and the turbine rotor 30 is disposed on the rotor bearing 301 (see FIG. 1). This state is referred to as a Tops Off state. Then, in the Tops Off state, a gap amount which intervenes between the rotating unit and the stationary unit is measured and a relative position between the rotating unit and the stationary unit is adjusted.

Next, the nozzle diaphragm upper half portion 451 is disposed on the nozzle diaphragm lower half portion 452, and the inner casing upper half portion 210 is disposed on the inner casing lower half portion 220 (see FIG. 1). This state is referred to as a Tops On state.

Then, the outer casing upper half portion 110 is disposed on the outer casing lower half portion 120 (see FIG. 1). Thereby, the installation of the steam turbine 1 is completed.

An operation and an effect of this embodiment will be described.

In the installation of the steam turbine 1, in the Tops On state, in addition to weights of the inner casing lower half portion 220 and the nozzle diaphragm lower half portion 452, weights of the nozzle diaphragm upper half portion 451 and the inner casing upper half portion 210 are applied to the support beam 130. Therefore, in the Tops On state, the support beam 130 is warped further than in the Tops Off state, so that deflection of the support beam 130 becomes larger.

Meanwhile, the turbine rotor 30 being the rotating unit is supported by the foundation F via the rotor bearing 301 and the bearing stand 302. Therefore, even when the support beam 130 is deflected, a position of the turbine rotor 30 does not change and is the same in the Tops Off state and the Tops On state.

As described above, between the Tops On state and the Tops Off state, the position of the rotating unit does not change and the position of the stationary unit changes, so that a width of the gap which intervenes between the rotating unit and the stationary unit changes.

In the steam turbine 1, contact between the rotating unit and the stationary unit is desired not to occur at a rated operation time, and additionally, at a startup time, at a stop time, and at a time of unsteady operation due to deformation of the stationary unit caused by a sudden inflow of low-temperature steam or high-temperature steam or the like. Therefore, the gap which intervenes between the rotating unit and the stationary unit is designed to fulfill the above-described requirement.

As described above, supporting the inner casing 20 by the support beam 130 brings about an advantage that deformation of the outer casing 10 does not have an influence. However, in this case, since deflection of the support beam 130 is likely to be large, the gap which intervenes between the rotating unit and the stationary unit is likely to change substantially.

This is because the support beam 130 has a long structure along the turbine rotor 30. In order for the smaller deflection of the support beam 130, it suffices to select a shape having a large second moment of area of the support beam 130. However, in this case, since the support beam 130 is large, a flow of steam toward the downward exhaust port 11 is hampered, resulting in a possible reduction of turbine performance. Further, a larger cross-sectional shape of the support beam 130 brings about a disadvantage that a cost of the support beam 130 is increased. Therefore, it is necessary to determine the most suitable cross-section of the support beam 130 in design in view of a balance among the deflection amount, the turbine performance, and the cost.

However, as already stated, as the steam turbine 1 becomes larger, loads of the inner casing 20 and the nozzle diaphragm 45 become large, it is sometimes difficult to decrease the deflection of the support beam 130 sufficiently.

In installation of the turbine rotor 30, there is adopted a method in which the turbine rotor 30 is made biased in a specific direction relatively by intentionally offsetting the nozzle diaphragm 45 and a packing (not shown) provided in the nozzle diaphragm 45 vertically and horizontally. Therefore, the deflection of the support beam 130, as long as with the deformation of a certain amount, can be coped with by offsetting. However, when the deflection of the support beam 130 becomes too large, sufficiently coping with by offsetting as described above is impossible, so that contact sometimes occurs between the rotating unit and the stationary unit in the Tops Off state. When the contact occurs between the rotating unit and the stationary unit in the Tops Off state, relative gap measurement cannot be performed, so that a relative positional relation cannot be grasped. Consequently, it is sometimes difficult to install the turbine rotor 30 with an intended gap.

In order to maintain the gap for not generating contact between the rotating unit and the stationary unit also in the Tops Off state, it is necessary to enlarge the gap between the rotating unit and the stationary unit. Consequently, since steam leaking is increased also at a rated operation time due to the enlarged gap, turbine performance is sometimes reduced.

In this embodiment, the height adjustment screw 160 capable of accessing the beam end portion 131 of the support beam 130 from the outside of the outer casing is provided above the beam end portion 131, as described above. Therefore, in this embodiment, after completion of setting of the nozzle diaphragm upper half portion 451, setting of the inner casing upper half portion 210, and setting of the outer casing upper half portion 110, the deflection of the support beam 130 can be made smaller by using the height adjustment screw 160.

The above-described operation and effect will be described concretely.

When the deflection occurs in the support beam 130 in the Tops On state, as is known from FIG. 4, the support beam 130 comes into a state where, with a fulcrum being a point P1 which is positioned inner side in a part in contact with an upper surface of the low-friction member 150 in a lower surface of the beam end portion 131, a point P2 on a tip side which is positioned outer side floats upwards. Therefore, in this embodiment, as illustrated in FIG. 4, by turning the height adjustment screw 160 in the outside of the outer casing 10, the beam end portion 131 is pushed downward in the vertical direction z via the second block 172. Thereby, in the support beam 130, a center portion of the support beam 130 moves upward with the point P1 being the fulcrum. Consequently, in this embodiment, the deflection of the support beam 130 can be made smaller. In other words, in this embodiment, since the deflection of the support beam 130 can be made smaller by using the height adjustment screw 160 after the Tops On state, it is possible to adjust the gap amount which intervenes between the rotating unit and the stationary unit appropriately.

As described above, when contact occurs between the rotating unit and the stationary unit in the Tops Off state, installation is impossible since the gap amount between the rotating unit and the stationary unit cannot be measured. However, in this embodiment, a similar effect can be achieved as in a case where a large offset amount is provided. Concretely, in a case where a gap is arranged to have an offset amount B larger than an offset amount A which is originally desired since contact occurs with the offset amount A, it is only necessary to right the deflection by a value C of a difference between the offset amount B and the offset amount A after the Tops Off state.

In this embodiment, an effect different from the above-described effect can be further achieved, as described below.

In installation of the steam turbine 1, it is necessary to measure amounts of deflection of the support beam 130 in the Tops On state and the Tops Off state. The steam turbines 1 of the same type have nearly equal deflection amounts, but considering an influence of individual difference generated in a manufacturing process, measurement is performed individually in general. As stated above, in conventional installation of a steam turbine 1, a Tops Off state is first made and deflection of a support beam 130, which becomes a benchmark, is measured. Then, after temporary assembling is performed to make a Tops On state once, deflection of the support beam 130 is checked. By using the above two measured amounts, an amount of deformation of the support beam 130 from the Tops Off state to the Tops On state is checked, and an offset amount for installation is determined. Then, after disassembling is performed to obtain the Tops off state again, a gap is adjusted and assembling is performed. Consequently, an installation process requires a long time.

However, in this embodiment, the height of the support beam 130 can be adjusted by using the height adjustment screw 160 in the Tops On state. In a case where the downward exhaust port 11 is provided on a bottom side of the steam turbine 1 as in this embodiment, deformation due to heat and pressure is bilaterally symmetrical. Therefore, change of the gap in the horizontal direction is generally caused only by movement of the rotor bearing 301 due to a lubricant film reaction force as a result of rotation of the turbine rotor 30, and thus, the change can be estimated without measurement. Therefore, in this embodiment, it is unnecessary to perform temporary assembling to make the Tops On state as well as disassembling, so that a time required for an installation process can be shortened.

In the above-described embodiment, the case is described where the steam turbine 1 is a downward exhaust type steam turbine and the downward exhaust port 11 is formed in a lower part of the outer casing 10, but the embodiment is not limited thereto.

Figure 5:
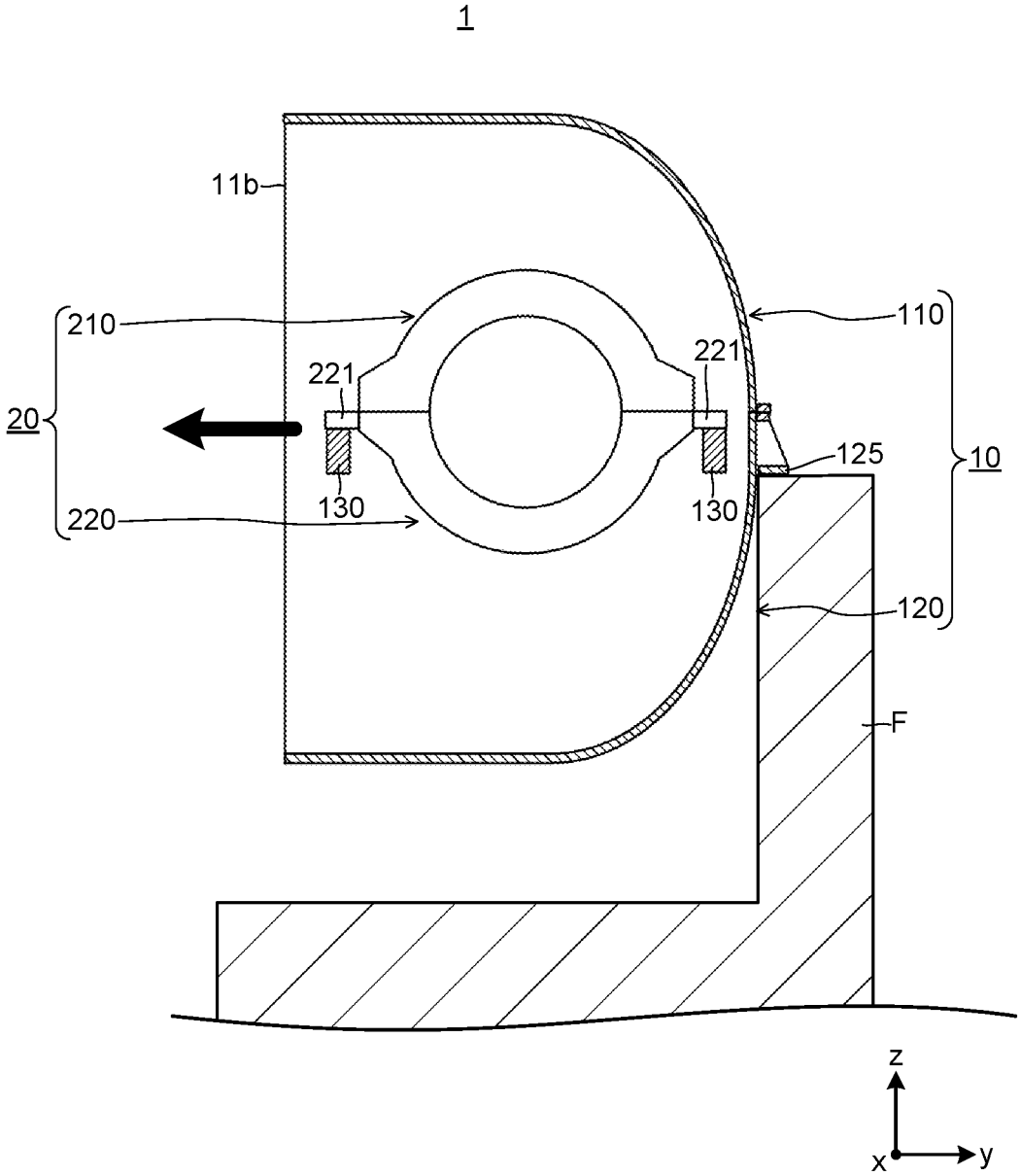
FIG. 5 is a side cross-sectional view schematically illustrating a steam turbine in a modification example of the embodiment.

A modification example will be described by using FIG. 5. FIG. 5 shows a side surface (yz surface) similarly to FIG. 3.

As illustrated in FIG. 5, a steam turbine 1 may be a lateral exhaust type steam turbine and a lateral exhaust port 11*b* may be formed in a side part of an outer casing 10. In this modification example, steam having worked in each turbine stage (not shown) is discharged from the lateral exhaust port 11*b*. Then, the steam discharged from the lateral exhaust port 11*b* flows to a steam condenser (not shown) connected to the steam turbine 1.

In this modification example, a second foot plate 125 is disposed on one side of a shaft axis AX of a turbine rotor 30 in a second horizontal direction y. In other words, the second foot plate 125 is disposed on an opposite side to a side of the lateral exhaust port 11*b*.

Also in this modification example, similarly to in the above-described embodiment, it is possible to reduce a loss due to steam leaking and improve turbine performance, and it is possible to shorten an installation process on-site.

Note that in this modification example, similarly to in the above-described embodiment, an inner casing 20 is supported by a pair of support beams 130, but the modification example is not limited thereto. For example, it is possible to configure such that an inner casing 20 is supported by one support beam 130 disposed on a side of the lateral discharge port 11*b* (left side). In this case, a support member (not shown) of an arbitrary shape may be used on an opposite side to the side of the lateral exhaust port 11*b*.

Several embodiments of the present invention have been explained, but these embodiments have been presented by way of example only, and are not intended to limit the scope of the invention. Those embodiments can be embodied in a variety of other forms, and various omissions, substitutions and changes may be made without departing from the spirit of the invention. These embodiments and their modifications are included in the scope and gist of the invention and are included in the invention described in claims and their equivalents.

REFERENCE SINGS LIST

1: steam turbine, 10: outer casing, 11: downward exhaust port, 11*b*: lateral exhaust port, 12: cone portion, 20: inner casing, 30: turbine rotor, 40: stationary blade, 41: diaphragm inner ring, 43: diaphragm outer ring, 45: nozzle diaphragm, 50: rotator blade, 60: turbine stage, 70: steam supply pipe, 110: outer casing upper half portion, 111: upper half end plate, 112: outer casing upper half main body, 113: upper half flange portion, 120: outer casing lower half portion, 121: lower half end plate, 122: lower half main body plate, 123: lower half flange portion, 124: first foot plate, 125: second foot plate, 126: plate, 130: support beam, 131: beam end portion, 141: first end wall, 142: second end wall, 143: ceiling wall, 150: low-friction member, 160: height adjustment screw, 171: first block, 172: second block, 210: inner casing upper half portion, 220: inner casing lower half portion, 221: arm portion, 301: rotor bearing, 302: bearing stand, 451: nozzle diaphragm upper half portion, 452: nozzle diaphragm lower half portion, AX: shaft axis, F: foundation, S124: support surface, SP: end portion housing space

What is claimed is:

1. A steam turbine disposed on a foundation, the steam turbine comprising:

an outer casing;

an inner casing housed in the outer casing;

a turbine rotor penetrating the inner casing and the outer casing; and a support beam provided in the outer casing, extending in an axial direction of the turbine rotor, and supporting the inner casing, wherein the outer casing comprises:

outer casing support portions provided in both end portions of the outer casing in the axial direction of the turbine rotor and supported by the foundation, the support beam comprises:

beam end portions provided in both end portions in the axial direction of the turbine rotor, the outer casing support portion comprises:

a support surface supporting the beam end portion, and the outer casing includes a height adjustment mechanism capable of accessing the beam end portion from the outside of the outer casing.

2. The steam turbine according to claim 1, wherein the inner casing comprises an arm portion supported by the support beam.

3. The steam turbine according to claim 1, wherein the outer casing comprises:

a downward exhaust port provided in a lower end portion and discharging steam downward, the inner casing is supported by a pair of the support beams, and the pair of the support beams are disposed to sandwich the inner casing in a horizontal direction.

4. The steam turbine according to claim 1, wherein the outer casing comprises:

a lateral exhaust port provided in a lateral end portion of the outer casing and discharging steam laterally, and the support beam is disposed at least on a side closer to the lateral exhaust port than the inner casing.

5. The steam turbine according to claim 2, wherein the outer casing comprises:

a downward exhaust port provided in a lower end portion and discharging steam downward, the inner casing is supported by a pair of the support beams, and the pair of the support beams are disposed to sandwich the inner casing in a horizontal direction.

* * * * *